United States Patent [19]

Bice, Jr.

[11] Patent Number: 4,893,358

[45] Date of Patent: Jan. 16, 1990

[54] GARMENTS HAVING AN ADJUSTABLE WAIST

[76] Inventor: Lorin L. Bice, Jr., 3335 Harding St., Long Beach, Calif. 90805

[21] Appl. No.: 270,781

[22] Filed: Nov. 14, 1988

[51] Int. Cl.[4] ..... A41D 1/06; A41D 1/14

[52] U.S. Cl. ..... 2/221; 2/237; 2/76

[58] Field of Search ..... 2/76, 221, 237

[56] References Cited

U.S. PATENT DOCUMENTS

| | | | |
|---|---|---|---|
| 701,252 | 5/1902 | Bandler | 2/237 |
| 1,022,410 | 4/1912 | Freedman | 2/221 |
| 1,735,657 | 11/1929 | Sacks et al. | 2/221 |
| 1,823,296 | 9/1931 | Sekey | 2/221 |
| 2,107,046 | 1/1938 | Rohatyn | 2/221 |
| 2,189,332 | 2/1940 | Spang | 2/76 |
| 2,216,030 | 9/1940 | Bardsley | 2/237 |
| 2,457,462 | 12/1948 | Gray | 2/237 |
| 2,581,627 | 1/1952 | Bubb | 2/237 |
| 2,755,481 | 7/1956 | Cantil | 2/237 |
| 2,903,707 | 9/1959 | Schimmel et al. | 2/221 |
| 3,431,562 | 3/1969 | Souders | 2/221 |
| 4,630,320 | 12/1986 | Van Gompel | 2/237 X |

*Primary Examiner*—Werner H. Schroeder
*Assistant Examiner*—Jeanette E. Chapman
*Attorney, Agent, or Firm*—Leonard Tachner

[57] ABSTRACT

A garment having a waist adjustment capability for simple and convenient changes in waist size with a minimum of motion and inconvenience. The waist adjustment feature of the present invention is formed by at least one foldable member which provides a Velcro fastening element which, when folded to selected extent over the remaining waist portion of the garment, mates with an interlocking Velcro fastening element to secure the folded member in selected position. The invention thus provides for reducing the waist size in accordance with the degree of folding selected. In a preferred embodiment of the invention, two such folding members are provided and are positioned along the lateral portion of the waist adjacent the hip region where they may be conveniently folded forward onto the front waist portion of the garment. The corresponding fold of the garment on each side adjusts not only the waist, but the hip and thigh region as well. An optional expandable member may be provided along the waist portion of the garment to enhance the appearance and fit of the garment after the waist size has been adjusted.

2 Claims, 3 Drawing Sheets

GARMENTS HAVING AN ADJUSTABLE WAIST

BACKGROUND OF THE INVENTION

FIELD OF THE INVENTION

The present invention relates generally to garments which have a waist portion such as trousers, shorts, skirts and the like and more specifically, to such garments having an adjustable waist whereby one configuration of such garments can be readily adjusted at the waist to accommodate a range of different sizes.

PRIOR ART

With today's increasing interest in fitness, has come a costly dilemma for both the serious and weekend athlete alike. Fluctuating waist sizes and increased muscularity in the leg and gluteal region have created the necessity for custom-made clothing. Those who cannot pay the high price for custom clothing must settle for poorly fitting garments which hardly flatter the well-built physique.

The adjustment of waist sizes in garments is not new per se, as may be noted in the following U.S. patents:

U.S. Pat. No. 2,910,982 Woodward
U.S. Pat. No. 3,027,566 Ruby
U.S. Pat. No. 3,081,772 Brooks et al
U.S. Pat. No. 3,141,457 Davidson
U.S. Pat. No. 3,500,478 Foster
U.S. Pat. No. 4,649,574 Michels
U.S. Pat. No. 4,651,353 Walden
U.S. Pat. No. 4,677,699 Barabe U.S. Pat. No. 4,649,574 to Michels is directed to a garment closure which includes a back elasticized band which is secured along an upper edge of the rear-enclosure segment. On one side there is a Velcro attachment first strip and a second strip which are interfaced respectively with Velcro strips. Thus, as seen in FIG. 3, this disclosure provides for adjustability on two sides. However, the design requires large overlapping flap panels.

U.S. Pat. No. 4,677,699 to Barabe is directed to a waistband adjustment for garments, and provides for a waistband adjustment including a first flexible strip which is secured to the inside of the waistband of the pants. The first flexible strip has an outer facing of Velcro loops and a second flexible strip, which is co-extensive to the first flexible strip, is provided with a removable attachment to the first flexible strip in order to accommodate waist size change. A second flexible strip includes Velcro hook fasteners, as is obvious.

U.S. Pat. No. 3,500,478 to Foster is directed to a waist closure for garments and shows in FIG. 1 a skirt, and in FIG. 6 a pair of pants. They provide for two pairs of Velcro strips to allow for changing waist sizes. However, this pant/waist control design uses a drop front piece to overlap the sides of the pants.

U.S. Pat. No. 3,081,772 to Brooks et al is directed to a diaper which includes matched connecting tapes on each side of the garment and although this may not be particularly directed to a waist changing size, it does allow for an extended area of adhesive attachment which would accommodate changing dimensions.

Unfortunately, each such prior art waist changing configuration suffers from one or more significant disadvantages. One such disadvantage by way of example is the complexity and high cost of manufacturing a substantially more complex garment in terms of additional labor and material. Another such disadvantage is the inconvenience and complexity of making waist size changes by the user. The waist size change inconvenience is particularly disadvantageous when the garment is being used in an application requiring frequent dressing and undressing or even frequent waist size changes during a limited period of time. Such an application may for example arise when the garment of the present invention is used by competing bodybuilding athletes whose waist sizes change dramatically over the course of a competition season. For sports or exercise related activities such as aerobics, jogging, calisthenics and the like, it is desirable for the user to be able to adjust his waist size to maximize comfort for the particular activity in which he is engaged. Unfortunately, prior art waist changing garments and particularly those which relate to the use of Velcro fastening elements often either require the garment to be removed before it can be adjusted or require a significant amount of twisting and turning in order to gain access to the fastening elements which are positioned in locations not necessarily most convenient to the user.

The invention is also advantageous to owners of large companies who require all employees to dress in like uniform. The simplicity of ordering one adjustable size in a high turnover market greatly reduces labor and stocking costs.

Previous inventions allowed only for a minimal waist size adjustment. The present invention provides for a greater waist size adjustment than previously allowed as well as a hip and thigh adjustment provided by the foldable members.

There has therefore been a long felt need for a garment waist adjustment configuration which provides the convenience and expediency of Velcro fastening elements, but which unlike the prior art known to the applicant, may be adjusted simply and conveniently with a minimum of motion such as twisting and turning and grasping toward the rear of the garment, without requiring partial or full removal or the garment and which may be accomplished in a mechanical manner without any significant amount of hand-eye coordination.

The present invention solves the aforementioned long felt need for a truly simple and convenient waist adjustable garment the waist adjustment feature of which comprises an elongated portion of Velcro material permanently affixed to the exterior of the garment along the waist and a corresponding mating Velcro portion permanently affixed to a foldable, member formed of the garment material. The foldable member is adjacent the waist and may be folded along the waist to either increase of decrease the waist size within a selected range depending upon the location of the interface between the mating portions of the respective Velcro members. In a preferred embodiment of the invention, a garment is provided with two such sets of Velcro fastening elements and two such foldable portions of the garment to enable the wearer to provide a symmetrical overlapping waist adjustment for increased comfort and improved appearance. In addition, the aforementioned preferred embodiment of the invention provides an expandable waist portion which may, by way of example, be positioned on the rear of the garment where it cannot interfere with the affixation of the Velcro fasteners to the garment and which thereby aids in providing increased adjustability of the waist size of the garment while also providing a more secure fit along the waist line of the garment.

In accordance with the present invention and particularly the preferred embodiment thereof shown in the accompanying drawings, the wearer of the garment may readily adjust the waist-size thereof by simply selecting the position of the Velcro mating portions relative to one another so that the interlocking members on the foldable portions of the garment make interlocking contact with different portions of the corresponding Velcro members sewn to the garment itself adjacent the foldable members. Thus, the degree of overlapping between the foldable member and the remainder of the garment along the waist, determines the size of the waist. By simply folding the foldable members so that the interlocking Velcro portions mate along their closest relative positions, the waist size may be maximized within the selected range. On the other hand, by simply folding the foldable members so that the mating Velcro portions are those which are ordinarily farthest apart when the folding members are unfolded, the waist size may be minimized within the selected range. In the preferred embodiment disclosed herein, the relative positions of the mating Velcro portions also determine the extent to which the expandable portion of the waist actually expands as will be seen hereinafter.

The invention is also advantageous to owners of large companies who require all employees to dress in like uniform. The simplicity of ordering one adjustable size in a high turnover market greatly reduces labor and stocking costs.

Previous inventions allowed only for a minimal waist size adjustment. The present invention provides for a greater waist size adjustment than previously allowed as well as a hip and thigh adjustment provided by the foldable members.

OBJECTS OF THE INVENTION

It is therefore a principal object of the present invention to provide a garment having an adjustable waist size wherein the adjustment may be accomplished by simply folding a foldable member and having interlocking Velcro mating portions, one such portion on the foldable member and one such portion on the adjacent exterior waist portion of the garment.

It is an additional object of the present invention to provide a garment having an adjustable waist size wherein there are provided two foldable members positioned on the lateral extensions of the garment adjacent the hip area, each such foldable portion having a Velcro mating member and wherein the garment provides interlocking corresponding Velcro portions along the exterior of the waist of the garment to mate with such foldable members whereby the extent of the fold onto the garment determines the size of the waist thereof.

It is still an additional object of the present invention to provide a garment having an adjustable waist size, but which overcomes or substantially reduces the disadvantages of the prior art by allowing waist size adjustment in a simple and expedient manner without requiring any substantial degree of turning or twisting by the wearer to make the adjustment.

BRIEF DESCRIPTION OF THE DRAWINGS

The aforementioned objects and advantages of the invention, as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
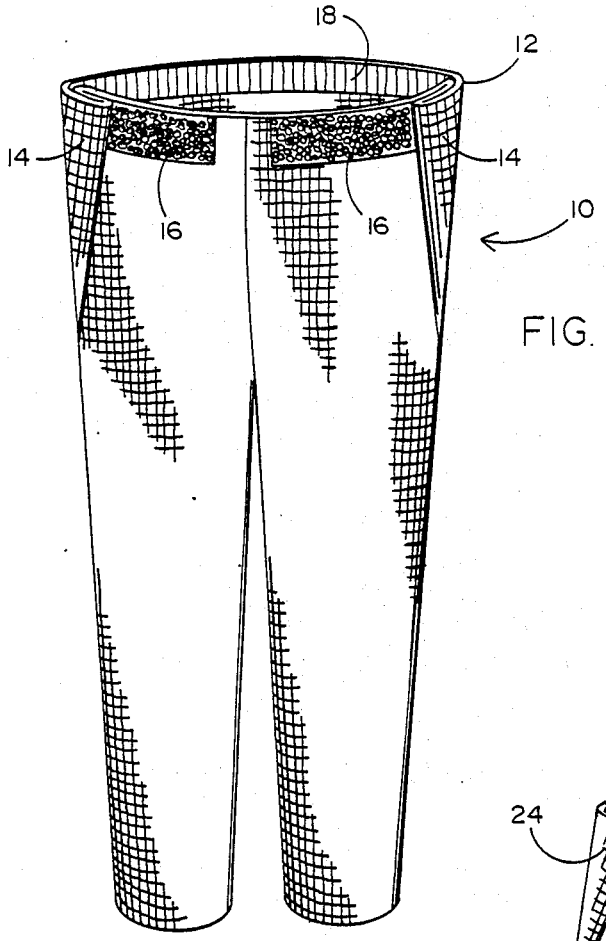
FIG. 1 is an elevational view of a trouser configuration of the present invention showing the foldable portions thereof in their folded configuration.
Figure 2:
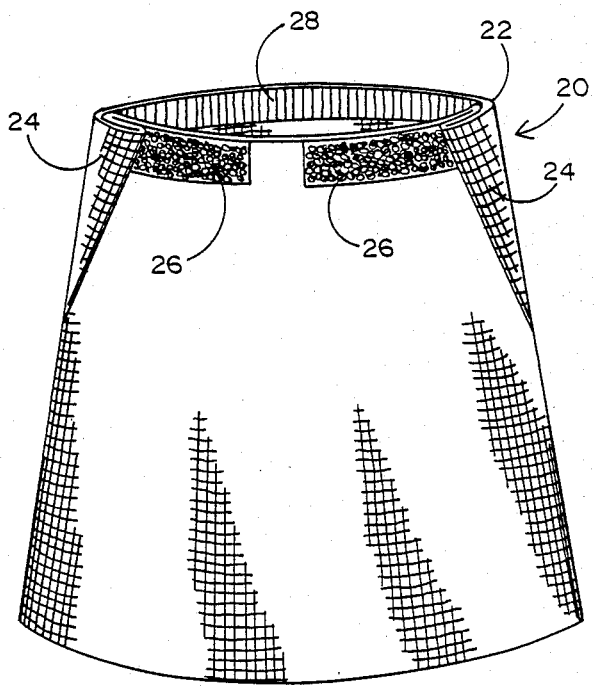
FIG. 2 is a view similar to that of FIG. 1 but showing an equivalent garment in a skirt form.

Referring now first to FIGS. 1 and 2 it will be seen that in one embodiment of the invention waist adjustment is provided in a pair of trousers 10 having a waist portion 12, a pair of foldable members 14 which connect to a corresponding pair of Velcro fasteners 16. The waist portion 12 is also characterized by an expandable member 18, which in the embodiment shown, forms a part of the waist portion toward the rear of the trousers. FIG. 2 illustrates the same advantageous waist adjustment feature of the invention in a skirt 20 similarly providing a waist portion 22 and a pair of foldable members 24 which fold onto corresponding Velcro fasteners 26. Similarly, an expandable member 28 is provided in the rear waist portion of skirt 20. In both FIGS. 1 and 2, the waist adjustment feature of the present invention is shown in its folded configuration and in substantially its largest waist size position.

Figure 3:
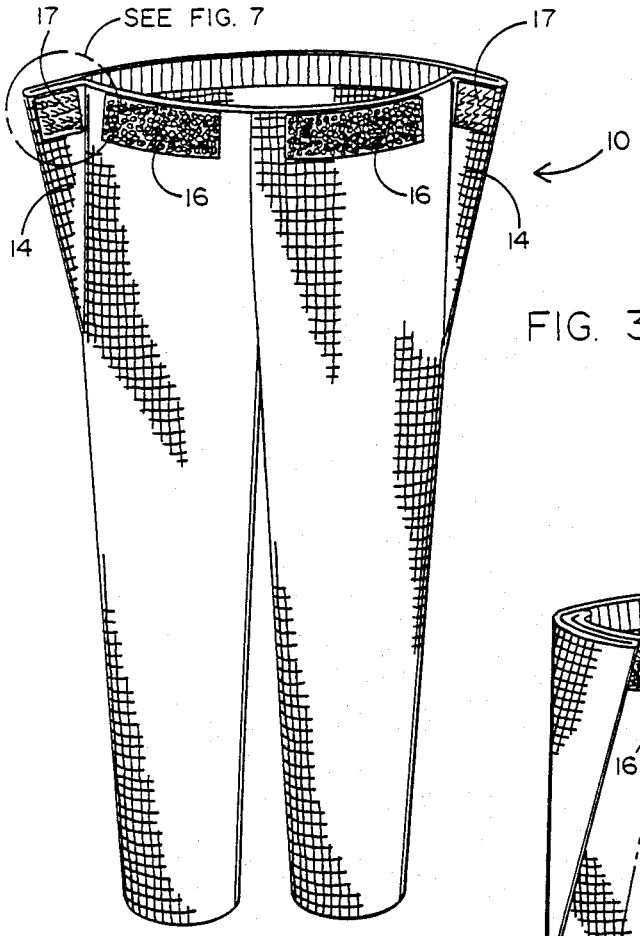
FIG. 3 is a view of a trouser garment similar to that of FIG. 1, but showing the foldable members thereof in their unfolded configuration.
Figure 4:
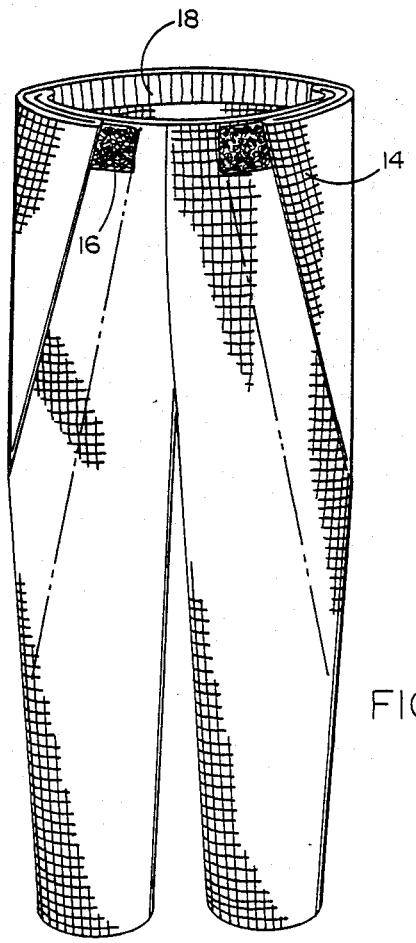
FIG. 4 is a view of a trouser configuration of the present invention showing two additional waist adjustment positions of the present invention, one in solid line and one in dashed line.
Figure 7:
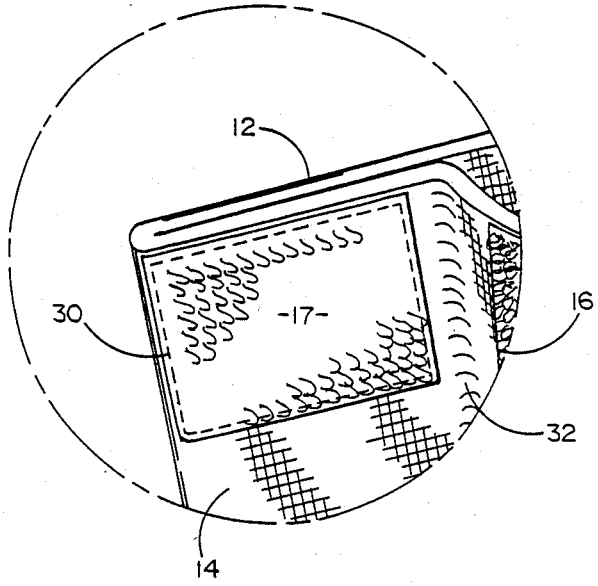
FIG. 7 is an enlarged view of that portion of FIG. 3 within the circle labeled "See FIG. 7".

Referring now to FIG. 3, it will be seen that the trousers 10 of FIG. 1 are again shown, but in this figure with the foldable members 14 of the present invention unfolded revealing the mating Velcro fastener 17 sewn on to each such foldable member. In the enlarged view of the upper portion of foldable member 14 provided in FIG. 7, it will be seen that the mating Velcro fastener 17 is sewn by means of stitching 30. This stitching extends through both layers of underlying fabric so that in effect, the same stitching that secures the mating Velcro fastener 17 to the foldable member 14 forms the foldable member itself. As seen further in FIG. 7, there is at least initially a fold line 32 positioned between the Velcro fastener 16 and the mating Velcro TM fastener 14. However, it will be understood that this fold line 32 may travel toward and onto Velcro fastener 16 depending upon the extent to which the foldable members 14 are wrapped around the waist of the wearer and the extent to which they cover the Velcro fasteners 16. Thus, for example, as illustrated in FIG. 4, foldable members 14 may be folded so that mating Velcro fasteners 17 mate with the outer portions of Velcro fastener 16, whereby the fold line 32 would remain substantially where it is shown in FIG. 7. However, if it is desirable to reduce the size of waist portion 12, the respective foldable members 14 may be folded to the point represented by the dashed line in FIG. 4, whereby the mating Velcro fasteners 17 would substantially overlap the innermost portion of Velcro fastener 16 thereby moving the fold line 32 onto the respective Velcro fastener 16.

Figure 5:
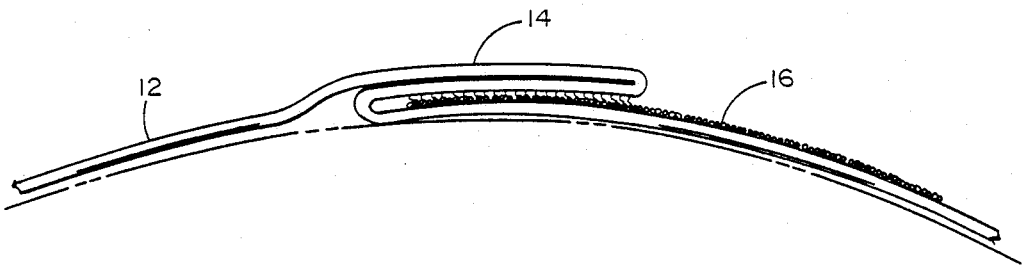
FIGS. 5 and 6 provide top views of the mating portions of the Velcro members of the invention and the portions of the garment to which they are affixed, in respectively different waist size configurations.
Figure 6:
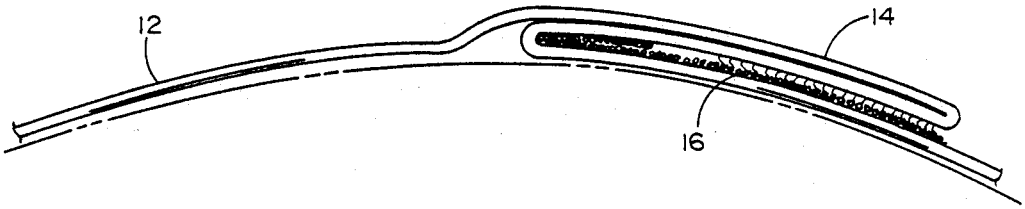

This variation in the position of the fold line 32 is a function of the folded waist size of the present invention as further demonstrated in FIGS. 5 and 6. FIG. 5 corresponds to the folded position of the present invention for a larger waisted person and FIG. 6 corresponds to the folded position of the present invention for a smaller waisted person. As previously indicated, the preferred embodiment of the invention is provided with an expandable member 18 which, for example, may be located along the rear waist portion of the garment. It will be understood that this expandable member 18 can expand to accommodate the different extents to which foldable members 14 overlap the Velcro fastener 16 in order to provide a neat appearing and snug fitting garment irrespective of the waist size adjustment selected. However, it will be also understood that the expandable member 18 is not a necessary portion of the invention and that a garment having the advantages of the present invention may be provided wherein there is no expandable member along the waist portion of the garment. In that configuration of the invention, the waist adjustment feature may be carried out entirely by the repositioning of the foldable members 14.

It will now be understood that what has been disclosed herein comprises a new and advantageous waist adjustment garment which finds particularly advantageous application in such garments as trousers, skirts, shorts and the like. However, it will be understood that the present invention may also be used with other garments which have a waist portion, such as long blouses, shirts and jackets. One of the principal advantages of the present invention is the ease and simplicity of waist adjustment making it convenient for a wearer to expeditiously modify the waist size of his garment with a minimum of effort and without requiring any substantial degree of turning and twisting in order to gain access to more complex waist adjustment devices of the prior art. The waist adjustment feature of the present invention is formed by at least one foldable member which provides a Velcro fastening element which, when folded to a selected extent over the remaining waist portion of the garment, mates with an interlocking Velcro fastening element to secure the folded member in the selected position. The invention thus provides for expanding or reducing the waist size in accordance with the degree of folding selected. In a preferred embodiment of the invention, two such folding members are provided and are positioned along the lateral portion of the waist adjacent the hip region where they may be conveniently folded forward onto the front waist portion of the garment. An optional expandable member may be provided along the waist portion of the garment to enhance the appearance and fit of the garment after the waist size has been adjusted.

Those having skill in the art to which the present invention pertains will now, as a result of the applicant's teaching herein, perceive various modifications and additions which may be made to the invention. By way of example, the type of garment, the shape and position of the foldable members, the relative positions and sizes of the Velcro fastening elements and the position of the expandable member, may all be varied while still providing the advantageous waist adjustment feature of the invention. Accordingly, all such modifications and additions are deemed to be within the scope of the invention which is to be limited only by the claims appended hereto.

I claim:

1. In a garment having a waist portion, a waist adjustment comprising:

at least one foldable member formed from an excess portion of said waist portion folded back upon itself to form two layers secured each to the other, said excess portion being foldable onto the remainder of said waist portion in contiguous engagement therewith;

means on said foldable member and said remainder of said waist portion for selectively affixing one to the other at different relative positions, the relative positions of affixing determining the adjusted size of said garment waist portion, said affixing means comprising a pair of complementary hook and loop fastening elements, a first of said pair of fastening elements being secured to said foldable member and a second of said pair of said fastening elements being secured to said waist portion, said second element having a greater length dimension than said first element, whereby said relative positions of said first and second elements may be selectively affixed at any one of a plurality of non-discrete locations along said length dimension of said second element; and, means for coupling said first fastening element to said foldable member, said coupling means securing said two layers of said foldable member each to the other while simultaneously securing said first fastening element thereto.

2. The waist adjustment recited in claim 1 further comprising an expandable member forming a part of said remainder of said waist portion.

* * * * *